US005548245A

United States Patent [19]

Bohlen et al.

[11] Patent Number: 5,548,245

[45] Date of Patent: Aug. 20, 1996

[54] ELECTRON BEAM TUBE ARRANGEMENTS HAVING THE INPUT CAVITY COMPRISED OF ELECTRICALLY INTERNAL AND EXTERNAL BODY PORTIONS

[75] Inventors: Heinz P. Bohlen; Edward S. Sobieradski; Mark Bridges, all of Chelmsford; Steven Bardell, Great-Dunmow; Alan H. Pickering; Howard T. Pettas, both of Chelmsford, all of England

[73] Assignee: EEV Limited, United Kingdom

[21] Appl. No.: 60,561

[22] Filed: May 13, 1993

Related U.S. Application Data

[63] Continuation-in-part of Ser. No. 664,572, Mar. 6, 1991, abandoned.

[30] Foreign Application Priority Data

| | | | |
|---|---|---|---|
| Mar. 9, 1990 | [GB] | United Kingdom | 9005380 |
| Mar. 9, 1990 | [GB] | United Kingdom | 9005382 |
| Apr. 13, 1993 | [GB] | United Kingdom | 9307552 |
| Apr. 19, 1993 | [GB] | United Kingdom | 9308003 |

[51] Int. Cl.[6] ..... H01J 23/15; H01J 23/48; H01J 25/04

[52] U.S. Cl. ..... 330/45; 315/5.37; 315/5.39

[58] Field of Search ..... 315/4, 5, 5.33, 315/5.29, 5.37, 5.39; 330/44, 45

[56] References Cited

U.S. PATENT DOCUMENTS

| | | | |
|---|---|---|---|
| 2,353,742 | 7/1944 | McArthur | 315/5.39 X |
| 2,425,748 | 8/1947 | Llewellyn | 330/45 X |
| 2,442,662 | 6/1948 | Peterson | 330/45 |

OTHER PUBLICATIONS

Priest et al., "The Klystrode–An Unusual Transmitting Tube with Potential for UHF–TV," IEEE Proc., vol. 70, No. 11, Nov. 1982, pp. 1318–1325.

*Primary Examiner*—Benny T. Lee
*Attorney, Agent, or Firm*—Spencer & Frank

[57] ABSTRACT

A linear electron beam tube has voltages provided thereto, an electron gun, and an output resonant cavity operatively arranged together. An internal body portion, an external body portion and an insulating portion are provided. The internal body portion, external body portion, and insulating portion at least partially define an annular input resonant cavity. The internal body portion is provided with a high voltage, with respect to the external body portion, and the internal and external body portions are separated by the insulating portion so that the internal and external body portions have no electrically conductive connection therebetween. The internal body portion is in electrical contact with the electron gun. The annular input resonant cavity at least partially defined by the internal and external body portions surrounds the electron gun. The annular input resonant cavity includes two transverse walls, at least one of the transverse walls being part of the internal body portion and part of the external body portion, and a member of insulating material disposed between these body portion parts.

51 Claims, 8 Drawing Sheets

ELECTRON BEAM TUBE ARRANGEMENTS HAVING THE INPUT CAVITY COMPRISED OF ELECTRICALLY INTERNAL AND EXTERNAL BODY PORTIONS

CROSS-REFERENCE TO RELATED APPLICATION

This application is a continuation-in-part of application Ser. No. 07/664,572, filed Mar. 6th, 1991, and now abandoned.

FIELD OF THE INVENTION

This invention relates to electron beam tube arrangements and more particularly to input resonator cavities of such arrangements at which high frequency energy is applied.

BACKGROUND TO THE INVENTION

The present invention is particularly applicable to an inductive output tetrode device (IOT) such as a KLYSTRODE (Registered Trade Mark, Varian Associates Inc). The advantages of inductive output tetrode devices (hereinafter referred to as "IOTs") are well known but previously proposed designs have suffered from problems in that it has been necessary to provide a number of tubes, each of which may be required to be used with a number of different cavities in order to provide the instantaneous bandwidth required (e.g. 8 MHz) over the entire television frequency range (e.g. 470–860 MHz). In klystrons, this requirement is currently met by stagger tuning of the various cavities included along the electron beam path to give outputs at different frequencies which add to provide the required bandwidth. However, this is not possible with conventional IOT design.

Another problem which has been encountered results from the high voltages on the order of 30 kV, which the cathode and grid must maintain, especially since the input cavity may define an external part of the IOT and therefore might be handled in normal usage. The present invention arose from an attempt to provide a system which obviates or mitigates some or all of the problems associated with maintaining high cathode and grid voltages while providing an IOT suitable for television applications.

SUMMARY OF THE INVENTION

In accordance with a first aspect of the present invention, there is provided an electron beam tube arrangement comprising: an input resonant cavity at least partially defined by an internal body portion and an external body portion, the internal body portion being maintained at a high voltage with respect to the external body portion and said body portions having no electrically conductive connection therebetween.

By "high voltage" it is meant on the order of tens of kilovolts.

Although the invention arose from the consideration of IOT devices, it is envisaged that it may be applicable to other forms of electron beam tube arrangements, such as klystrons, which have Input resonant cavities.

The external body portion is typically at & very low voltage, usually grounded.

It is preferred that the body portions are physically joined together by a dielectric insulator portion, which advantageously is molded. The body portions can also be provided with mutually interengaging formations to assist in the joining of the two body portions. These formations are advantageously dimensioned so as to define a very high d.c. impedance path but a very low r.f. impedance path at the joint to inhibit r.f. leakage from the cavity while enabling the required voltage difference between the external and internal body portions to be maintained.

It may be preferred that an electrical connection be provided between the outside of the cavity and the internal body portion through the insulator material.

Advantageously, the input resonant cavity is a primary cavity and a secondary resonator cavity is included, being coupled to the primary cavity.

It is preferred that the cavities are tuned to respective different frequencies, making a larger bandwidth available than would be the case if only one cavity were used.

Advantageously, the resonant frequencies of the primary and secondary cavities are tunable. The tuning may be carded out independently or could be linked, for example, so that a change made in the resonant frequency of one cavity results in a corresponding change in that of the other cavity.

The volume of the primary cavity may be varied by means included in the external body portion to adjust the resonant frequency.

According to a second aspect of the invention, the inner and outer body portions each include an axially extensive flange substantially coextensive in an axial direction and electrically insulating material being located between the flanges.

The arrangement of the flanges of the inner and outer body portions enables the two portions to be separated to achieve the desired electrical isolation between them while permitting the input cavity to be such that there is low r.f. leakage from it, thereby affording efficient operation. Also, the flanges extend in substantially the same direction and hence are substantially parallel to each other. This is particularly advantageous as it reduces electrical stresses and therefore the tendency of voltage breakdown to occur between the inner and outer body portions, even at high voltages. Furthermore, the arrangement of the inner and outer body portions and axially extensive flanges is relatively easy, and therefore inexpensive, to fabricate and assemble.

It is preferred that the flanges are substantially cylindrical, as this is a symmetrical configuration which is usually desirable in linear electron beam tubes as it gives good electrical characteristics and results in a mechanically robust arrangement.

Preferably, each of the inner and outer body portions includes two flanges extensive in an axial direction outwardly from the input cavity, there thus being two pairs of co-extensive flanges. Such an arrangement minimizes r.f. losses in the region between the inner and outer body portions. Although the input cavity could alternatively comprise only one pair of flanges, this would tend to result in an r.f. leakage path being present between other parts of the cavity.

It is preferred that the inner body portion comprises two sections which are electrically separate from one another. Again, this facilitates manufacture and assembly and advantageously also permits different voltages to be applied to different parts of the electron gun via the inner body portion. In one preferred embodiment of the invention, the inner body portion is electrically connected to a cathode and a grid of the electron gun. Where two sections are included, one of them may be physically and electrically connected to the cathode and the other to the grid.

Advantageously, the electrically insulating material is generally cylindrical in form. This permits insulation to be distributed in a symmetrical manner around the longitudinal axis of the tube and also may provide mechanical support and rigidity. Where two pairs of flanges are included in the arrangement, the electrically insulating material may be present as two separate rings, for example, one ring being interposed between one pair of flanges and the other between the other pair. Alternatively, and preferably, the electrically insulating material is a unitary member which is extensive between both pairs of flanges.

Advantageously, the inner and outer body portions are physically joined together by the electrically insulating material which may, for example, be molded into a particular shape.

According to a third aspect of the invention, the inner and outer body portions have respective parts which are co-extensive to present a choke impedance to high frequency energy within the input cavity and wherein an edge of one or more of the parts terminating in a region where a part of the other body portion is extensive is curved.

Use of the invention, enables increased voltage hold-off to be obtained between the co-extensive parts. The curved edge of the part or parts reduces electrical stresses compared to an arrangement in which no such curvature is employed when electrical field lines tend to be concentrated at the end of a part. Thus, by employing the invention, greater design freedom is offered in selecting spacing between the co-extensive parts. This may result in a more efficient choke impedance being feasible and may also lead to a more compact arrangement.

Only one of the parts may have a curved edge but it would generally be desirable for both or all parts to have curved edges where these terminate in regions of high electrical field.

In one preferred embodiment of the invention, the parts, including their edges, are substantially planar and the edge is curved out of the plane. The parts may be flat plates or may be planar and curved, that is, cylindrical. In the latter case, the edge is the end of the cylinder and may be curved inwardly or outwardly depending on the particular arrangement. In an alternative embodiment the curved edge is a solid rim of, say, circular cross-section similar to a beading along the end of the part. For example, it may be a region of increased thickness around the inner circumference of a flat annular plate.

Preferably, the edge is curved such that its end is substantially adjacent a region of the part remote from the edge. The edge may be curved sufficiently so that its end actually touches the surface of the part or may be spaced a little way from it. It a preferred embodiment, the edge is curved with a substantially constant radius of curvature. However, the edge could be folded over to present a more oval cross-section.

In another embodiment of the invention, the respective parts are extensive in planes substantially transverse to the longitudinal axis. In one particular embodiment, one of the body portions includes two parts extensive in a substantially transverse direction and the other includes one part located between them. In such an arrangement, advantageously, the two outermost parts have edges which curve in a direction away from the said one part. The one part may be located closer to one of the two parts than the other. In this case, it is preferred that it has an edge which is curved away from the part which is closer to it. In a particularly advantageous embodiment of the invention, the parts are annular plates, giving a cylindrically symmetrical arrangement.

In another embodiment of the invention, the parts are axially extensive flanges which are substantially co-extensive in an axial direction. Preferably, the flanges are substantially cylindrical.

In many arrangements, electrically insulating material is advantageously included between the co-extensive parts. This enables good voltage hold-off to be achieved and may also improve mechanical stability of the arrangement. Advantageously, at least one of the parts is at least partially embedded in the electrically insulating material. In some arrangements it may be desirable to wholly encase the parts in the material for optimum breakdown characteristics.

Preferably, the inner and outer body portions include two pairs of co-extensive respective parts. Such an arrangement minimizes r.f. losses in the region between the inner and outer body portions. Although the input cavity could alternatively comprise only one pair of said parts, this would tend to result in an r.f. leakage path being present between other portions of the cavity.

It is preferred that the inner body portion comprises two sections which are electrically separate from one another. Again, this facilitates manufacture and assembly and advantageously also permits different voltages to be applied to different parts of the electron gun via the inner body portion. In one preferred embodiment of the invention, the inner body portion is electrically connected to a cathode and a grid of the electron gun. Where two sections are included, one of them may be physically and electrically connected to the cathode and the other to the grid.

According to a fourth aspect of the invention, the inner and outer body portions have respective parts which are substantially co-extensive and resiliently deformable electrically insulating material is located between the said parts.

An electron beam tube in accordance with the invention may suffer from mechanical shocks and stresses during use of the tube and during shipping and handling, for example, for servicing requirements. Thermal cycling as the tube is brought to an operating temperature may also result in stresses between its components. In a conventional tube, shocks or stresses may cause cracks or other defects to appear between parts of the device. This may lead to severe problems where these parts are at widely differing electrical potentials when a crack form a path for electrical breakdown to occur. By using the invention, the integrity of the electrically insulating material itself and also its interface with other parts of the tube may be maintained as the material tends to deform under mechanical shock or stress, returning to its original state afterwards. Thus, although there is a loss in the rigidity of the tube in the input region, the consequential improvement in electrical hold-off characteristics under adverse conditions is highly advantageous. The resilient nature of the insulating material reduces the tendency for voids to be formed between the material and adjacent rigid members. Thus a substantially uniform dielectric constant may be maintained throughout the electrically insulating material which is important in avoiding electrical breakdown through it.

In a preferred embodiment of the invention, the electrically insulating material is of silicone rubber. This is a relatively easy material to conform to a required shape without any air bubbles or the like being included and is also able to withstand larger electrical stresses across it.

Preferably, the silicone rubber is molded to give the required configuration although other fabrication techniques could be used.

BRIEF DESCRIPTION THE OF DRAWINGS

Some ways in which the invention may be performed are now described by way of example with reference to the accompanying drawings in which.

Figure 3:
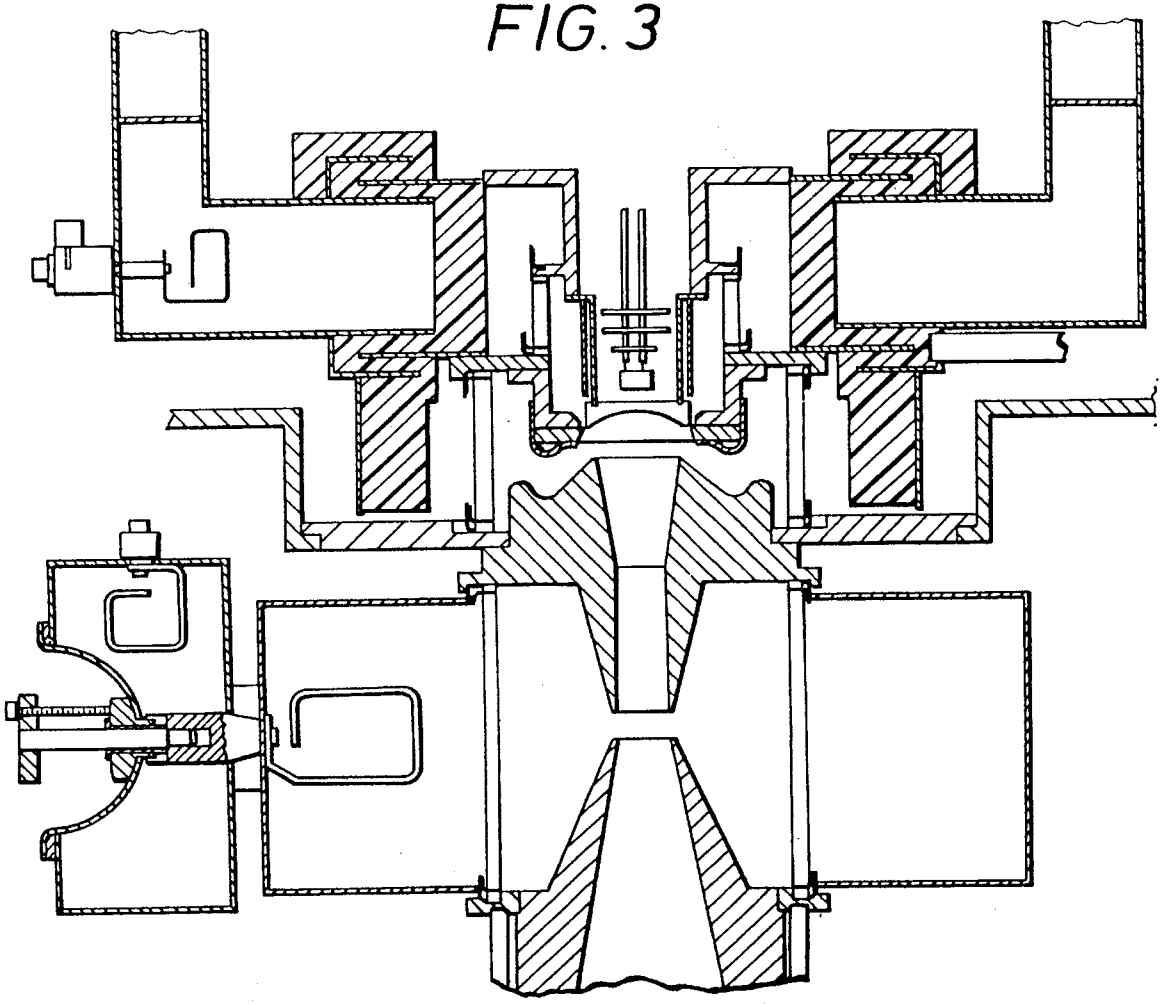
Figure 4:
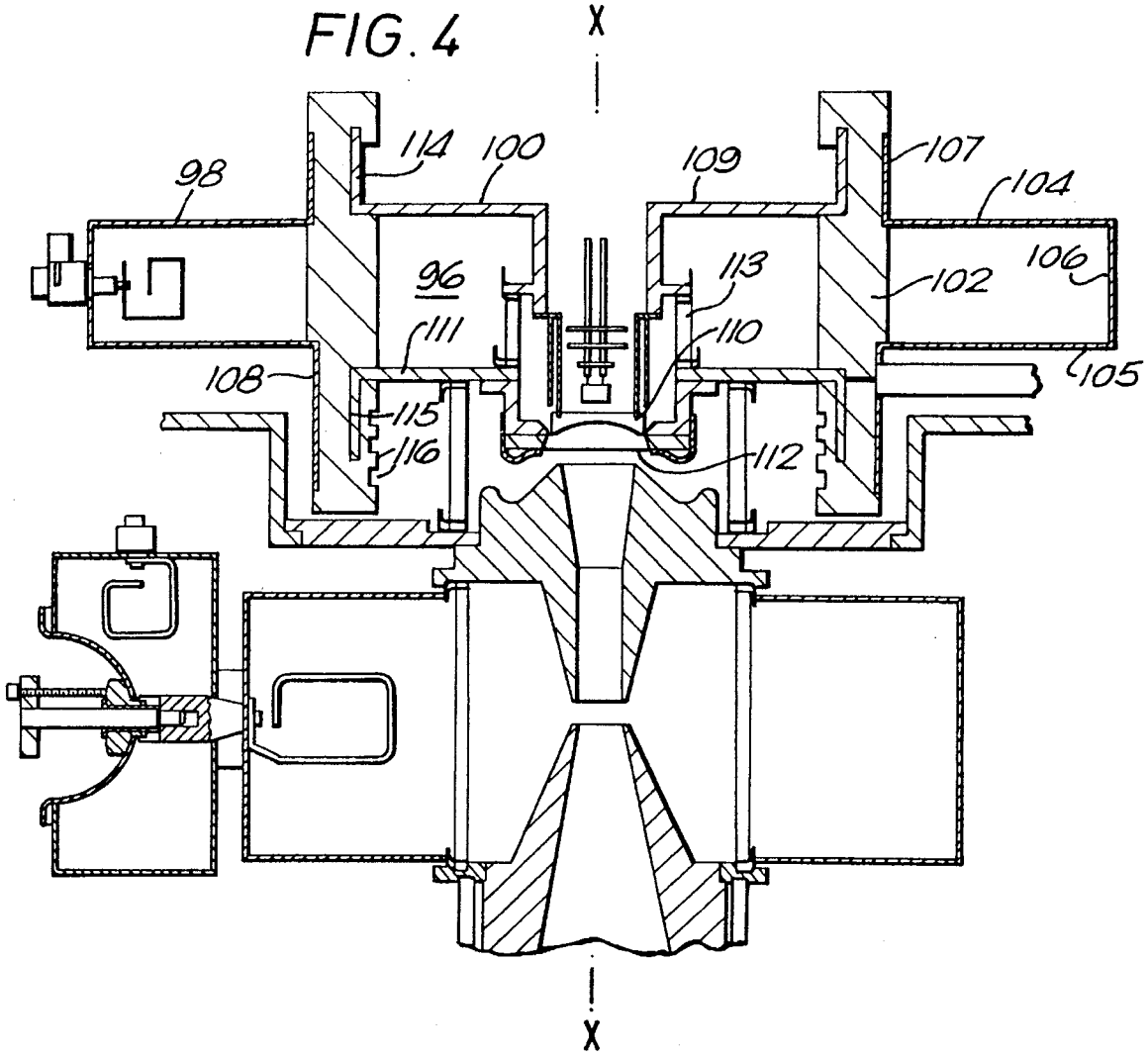
Figure 5:
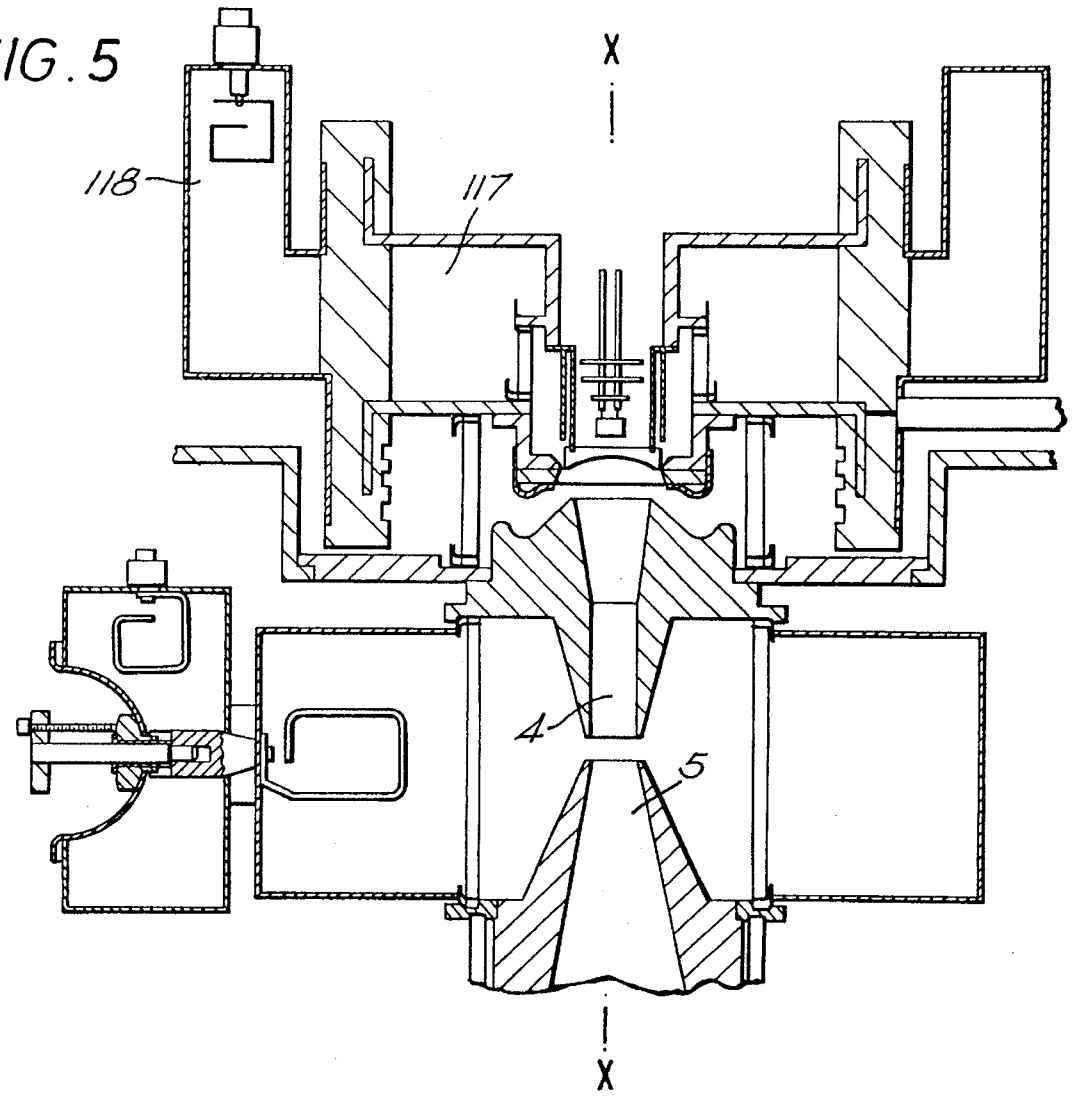
Figure 6:
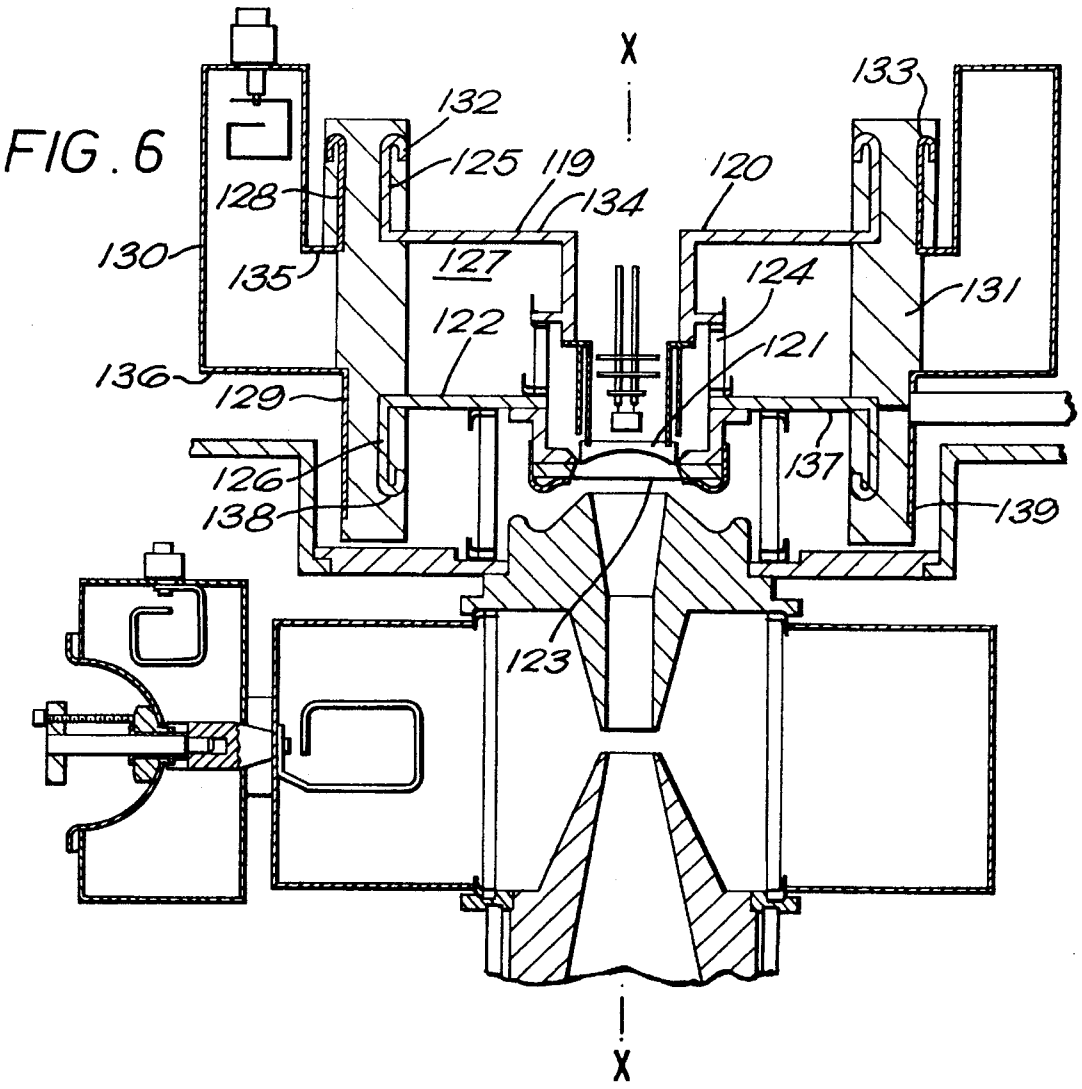
Figure 7:
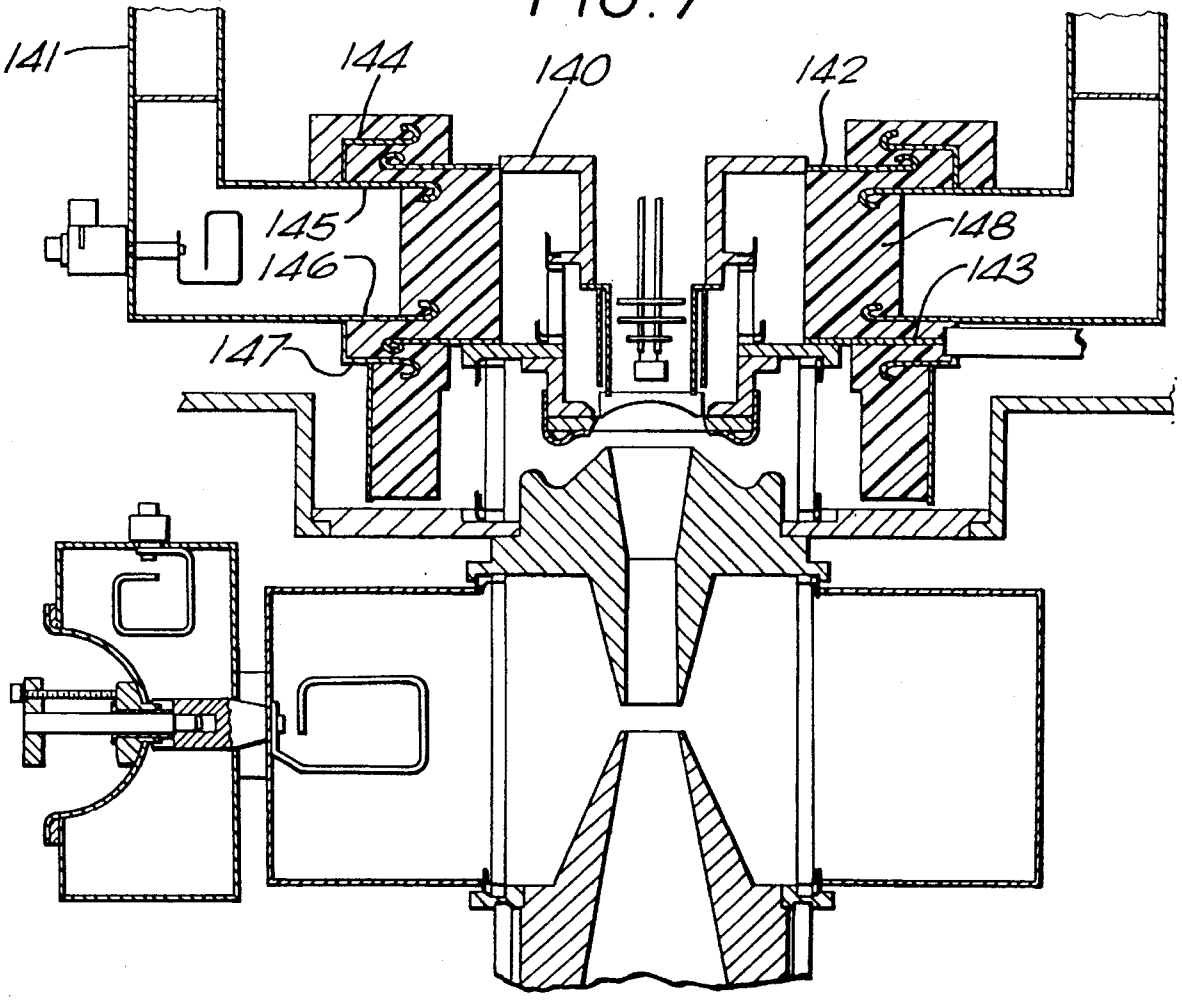
Figure 9:
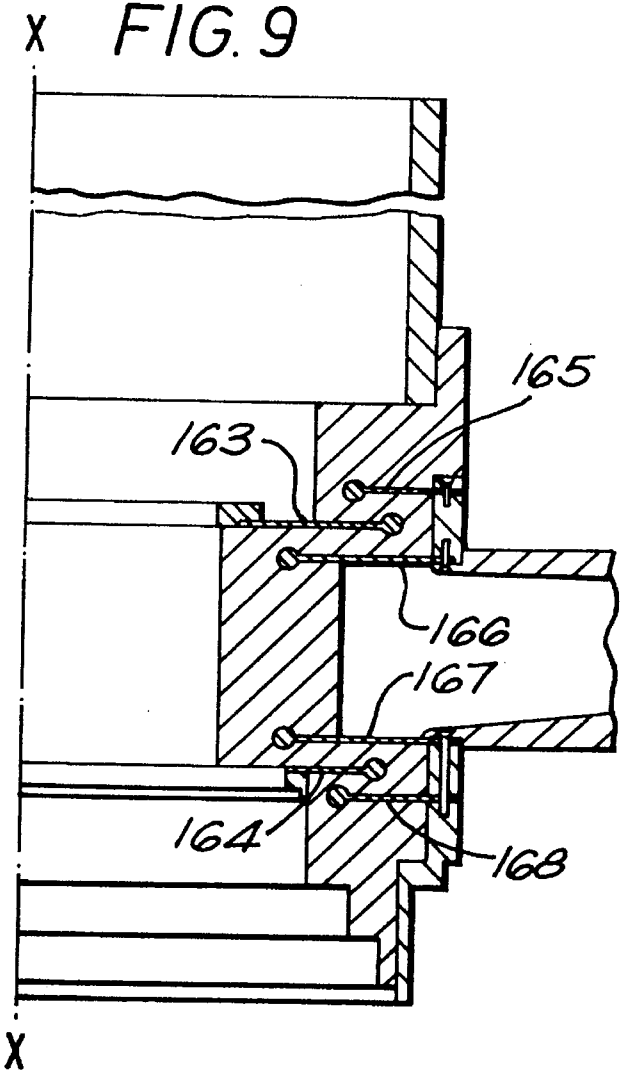
Figure 8:
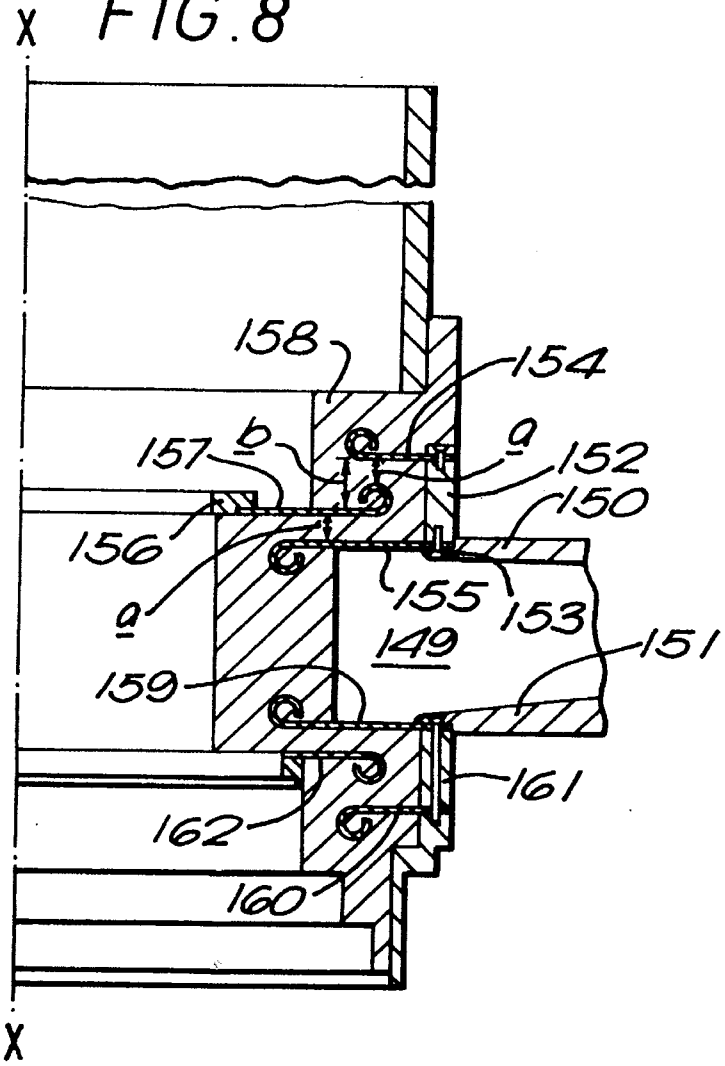

FIG. 3 schematically illustrates another embodiment in accordance with the invention; and FIG. 4 schematically illustrates another embodiment in accordance with the invention;

FIG. 5 schematically illustrates another embodiment in accordance with the invention;

FIG. 6 schematically illustrates another embodiment in accordance with the invention;

FIG. 7 schematically illustrates another embodiment in accordance with the invention;

FIG. 8 schematically illustrates another embodiment in accordance with the invention; and FIG. 9 schematically illustrates another embodiment in accordance with the invention.

DESCRIPTION OF PREFERRED EMBODIMENTS

Figure 1:
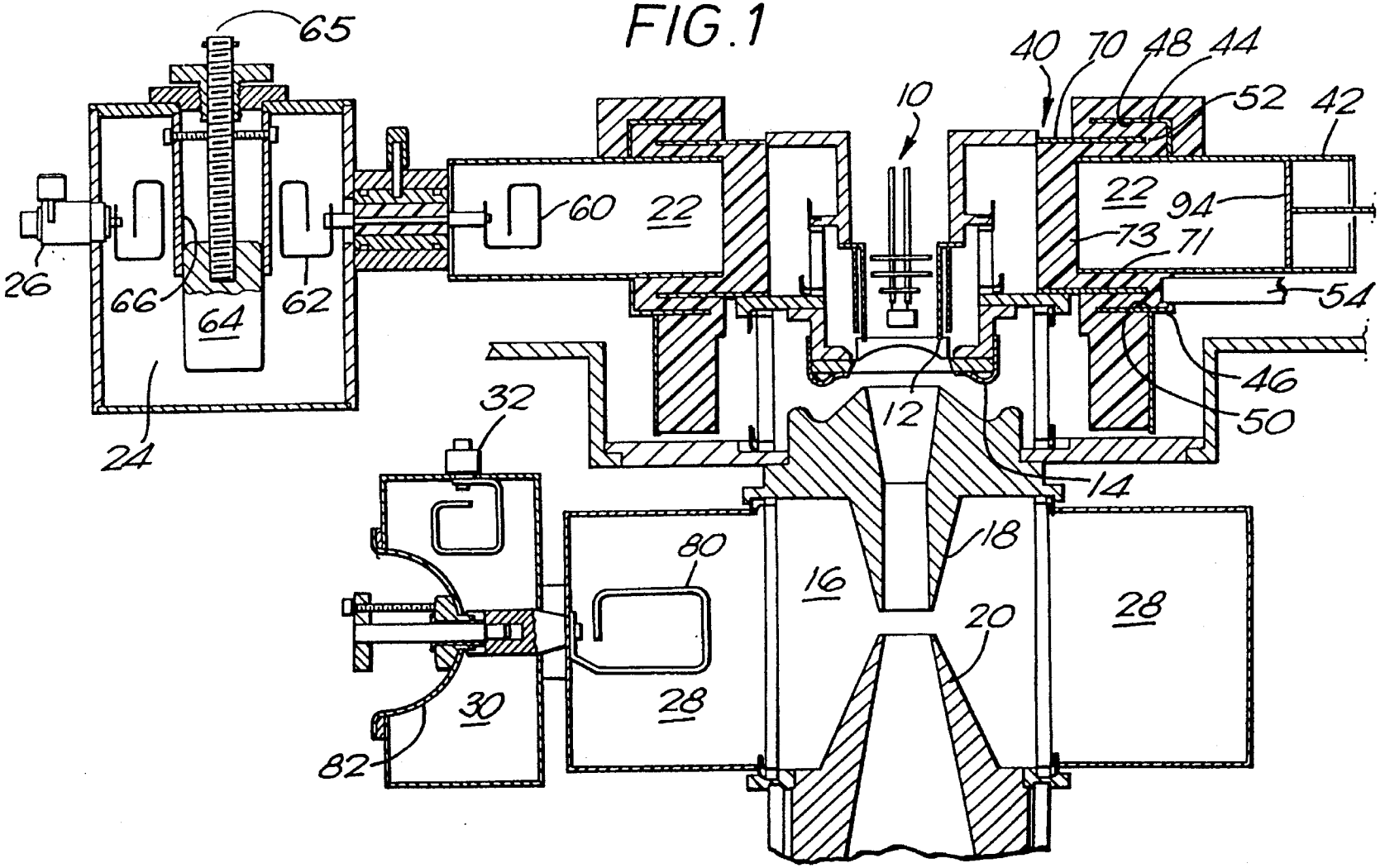
FIG.1 is a diagrammatic cross-section side view of an IOT in accordance with the present invention (parts have been omitted for clarity)

The IOT shown in FIG. 1 comprises an electron gun 10 incorporating a cathode 12 and grid 14, and an output section 16 incorporating drift tubes 18, 20. The input assembly including the electron gun 10, cathode 12 and grid 14 is surrounded by a primary input cavity 22 which is coupled to a secondary input cavity 24 having an input coupling 26. The output section 16 is surrounded by a primary output cavity 28 which is coupled to a secondary output cavity 30 having an output coupling 32.

In use, an r.f. voltage on the order of several hundred volts is produced between the cathode and grid while both are maintained at about 30 kV. It is also necessary that the grid 14 should be maintained at a nominal d.c. bias voltage on the order of negative one hundred volts with respect to the cathode.

In particular, the present invention relates to the primary input cavity 22 of the device shown in FIG. 1, for example. An internal body portion 40 comprises upper and lower annular metal plates 70, 71 separated by a dielectric material 73 so as to define an annular channel. The dielectric material 73 is resiliently deformable and in this case of silicone rubber. The upper plate 70 is electrically connected to the cathode and the lower plate 71 is electrically connected to the grid. The open part of the channel faces outwardly and embraces the open part of a further annular channel comprising a metal external body portion 42, the input cavity 22 being defined by the portions 40 and 42.

Angled flanges 44, 46 are provided on either side of the external body-portion 42 so as to define further annular channels 48, 50 into which the free edges of the internal body portion 40 project. However, there is no direct electrical contact between any part of the internal body portion 40 and any part of the external body portion 42 and the flanges 44, 46, a moulded insulating dielectric material 52 of silicone rubber being provided therebetween. This serves to insulate the exterior body portion 42 from the interior body portion 40 and hence from the very high voltage encountered in use. While the use of the dielectric 52 insulates the body portions 40, 42 electrically, there is still a potential path for r.f. leakage through the dielectric 52. Consequently, the dimensions of the overlapping paths of the portions 40, 42 are chosen to provide a very low r.f. impedance path and hence prevent as much r.f. leakage as possible.

The volume and hence the resonant frequency of the cavity 22 can be varied in a conventional manner, for example by using tuning doors (moveable tuners) as shown at 94.

Figure 2:
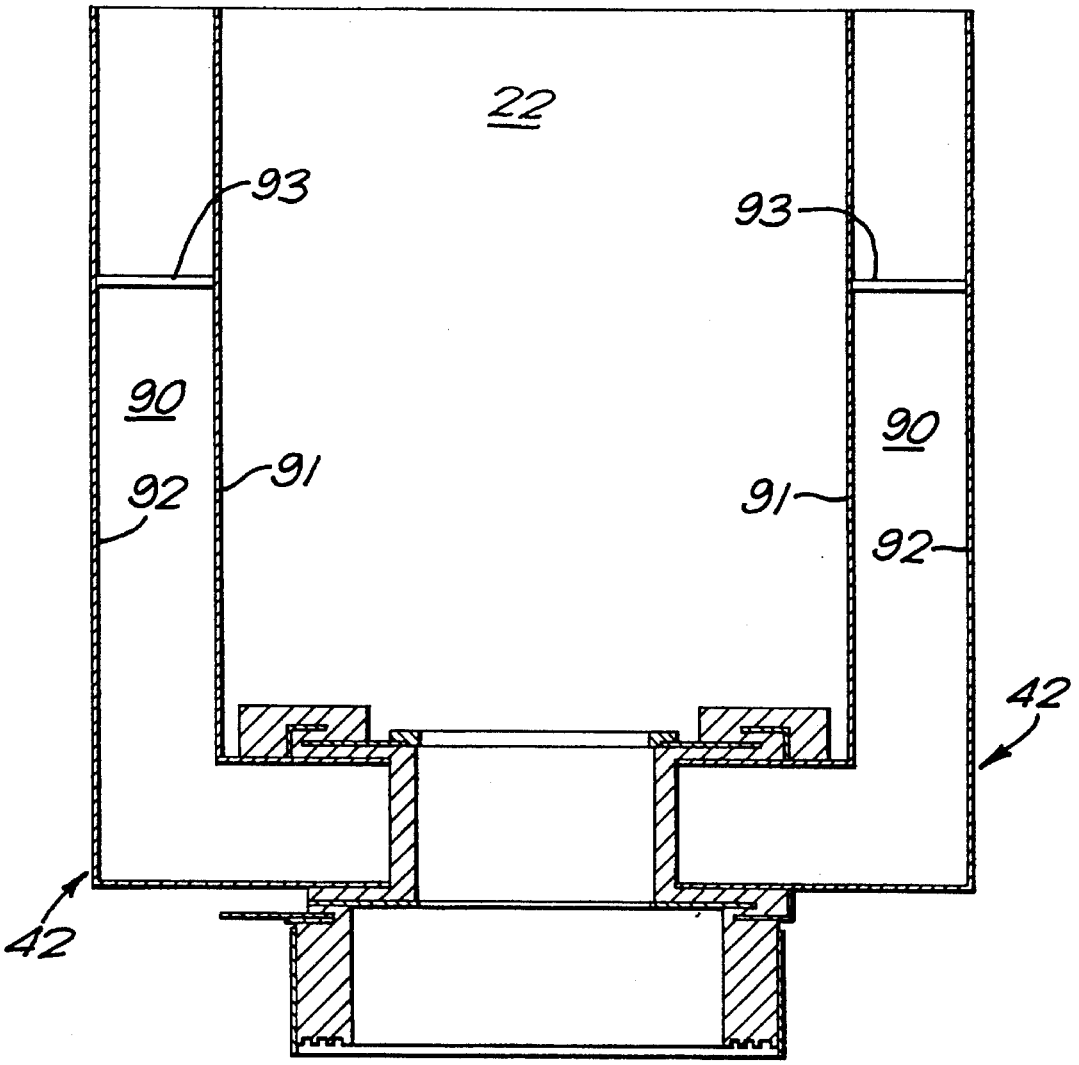
FIG. 2 is a schematic drawing of an alternative form of primary input cavity.

An alternative form of primary input cavity 22 is shown in FIG. 2. In this case, the external body portion 42 is extended in the axial direction so as to form an elongate annular region 90 which is defined by extended cylindrical walls 91, 92 of the body portion 42. The effective volume of the region 90 can be varied by means of a sliding plate 93 which can be moved axially by any suitable means.

In FIG. 2, the surfaces of the dielectric are shown as smooth but the voltage hold-off ability can be improved still further by providing a surface configured, say, as a crenellated form of ridges and grooves.

As shown in FIG. 1, a power lead 54 is muted through the dielectric 52 in order to maintain the grid 14 at the appropriate bias voltage while maintaining the electrical insulation of the exterior body portion 42, the connection being made via the lead 54 and plate 71.

The interior of the primary Input cavity 22 is linked to the secondary input cavity 24 by means of coupling loops 60, 62. The Internal volume of the secondary input cavity 24, and hence its resonant frequency, is adjustable by means of a movable plunger 64 on screw 65 projecting from a bore member 66. In this embodiment of the invention the volumes of the primary cavity 22 and the secondary cavity 24 are independently variable, but they could be linked to move together. The primary and secondary cavities 22 and 24 are arranged to have respective different resonant frequencies.

At the output end of the IOT a primary output cavity 28 surrounds the output section 16 and is tunable in the conventional manner. The cavity 28 is coupled to the secondary output cavity 30 by means of a coupling loop 80, the connection to the secondary cavity 30 including a domed formation 82 provided on an inner wall thereof. The tuning of the secondary cavity 30 can be achieved by conventional means.

With reference to FIG. 3, in another embodiment of the invention, only one input cavity is included in the arrangement. In this particular arrangement, the input cavity is similar to that illustrated in FIG. 2.

With reference to FIG. 4, another IOT in accordance with the invention is similar to that shown in FIG. 1 but has a single Input cavity 96 and a different r.f. choke configuration between an outer body portion 98 and an inner body portion 100. which have silicone rubber electrical insulating material 102 between them.

The outer body portion 98 is maintained at substantially ground potential, thus facilitating safe handling of device, whilst the inner body portion 100 is maintained at much higher voltages.

The outer body portion consists of two annular plates 104 and 105 arranged parallel to one another and transverse to the longitudinal axis X—X with a cylindrical outer wall 106 defining the outer extent of the cavity 96. The inner part of the outer body portion 98 includes two cylindrical flanges 107 and 108 extending outwardly from the cavity volume and arranged cylindrically about the axis X—X.

The inner body portion 100 comprises two sections. The first section 109 is mechanically and electrically connected to the cathode 110 and the second section 111 is mechanically and electrically connected to the grid 112. In the embodiment shown, a ceramic cylinder 113 is located between the sections 109 and 111 to give additional mechanical support to the assembly.

The inner body portion 100 also includes cylindrical flanges 114 and 115 which extend outwardly away from the input cavity 96 and are arranged coaxially about the axis X—X and within the flanges 107 and 108 of the outer body portion 98. The two pairs of flanges 107 and 114, and 108 and 115 are arranged to extend substantially parallel to one another and are substantially co-extensive in the axial direction. The outer flanges 107 and 108 are located in shallow channels in the outer surface of the dielectric member 102. The inner flange 114 which is connected to the cathode 110 is partially embedded within the member 102 and the other inner flange 115 is substantially wholly embedded within it.

The inner surface of the member 102 includes circumferential grooves 116 around the cathode 110 and grid 112 regions to improve voltage hold off ability. However, in other embodiments, this surface may be smooth.

Another IOT is shown in FIG. 5 and is similar to the FIG. 4 arrangement. However, in this device, the input cavity 117 includes an axially extensive portion 118 which forms part of the outer body portion. As in other embodiments, drift tubes 4 and 5 in the output section of the device are arranged along the axis X—X.

With reference to FIG. 6, an IOT is similar to that illustrated in FIG. 4 but includes a different interface between the inner and outer body portion.

The inner body portion 119 comprises two sections. The first section 120 is mechanically and electrically connected to the cathode 121 and the second section 122 is mechanically and electrically connected to the grid 123. In the embodiment shown, a ceramic cylinder 124 is located between the sections 120 and 121.

The inner body portion 119 also includes cylindrical flanges 125 and 126 which extend outwardly away from the input cavity 127 and are arranged coaxlaity about the axis X—X and within the flanges 128 and 129 of the outer body portion 130. The two pairs of flanges 128 and 125, and 129 and 126 are arranged to extend substantially parallel to one another and are substantially co-extensive in the axial direction. They define r.f. choke impedances and are substantially wholly embedded within insulating material 131, which again is silicone rubber.

Two of the co-extensive flanges 125 and 128 are extensive from the input cavity 127 over approximately the same axial distance and are substantially parallel to one another, The two flanges 125 and 128 have edges 132 and 133 which are curved away from each other such that each end of the flange is shielded from the other body portion by the axially extensive part of that flange. The parts of flanges 125 and 128 which are fixed to the outer and inner body portions defined by plates 134 and 135 are arranged to join in a smooth curve to reduce electrical stresses between the two body portions.

The other pair of co-extensive cylindrical flanges 129 and 126 are similarly curved where they join plates 136 and 137. The inner flange 126 extends in axial direction for approximately half the distance of the outer flange 129. Thus, the inner flange 126 terminates in a region where it is co-extensive with the outer flange 129 whereas the outer flange 129 terminates at a location remote from the inner flange 126. The inner flange 126 has a curved edge 138 which is curved away from the outer flange 129.

In this arrangement of co-extensive parts the end 139 of the outer flange 129 is not curved out of the plane of the flange 129.

Another IOT is shown in FIG. 7 and is similar in many aspects to the FIG. 3 arrangement. The input cavity includes parts which are extensive in a substantially transverse direction to the longitudinal axis and which are interleaved to provide the required dc isolation between the inner body portion 140 and the outer body portion 141 and providing an r.f. choke The inner body portion 140 comprises two annular plates 142 and 143. One of the plates 142 is connected electrically to the cathode and is interleaved between two annular plates 144 and 145 forming part of the outer body portion 141. The annular plate 143 is connected to the electrode gun grid and is interleaved with annular plates 146 and 147 which between them define an annular channel into which the plate 143 is extensive. The regions between the interleaved transverse parts are occupied by resiliently deformable electrically insulating material 148 which is of silicone rubber.

The outer edges of the annular plates 142 and 143 terminate in the annular channels and in the regions of the transverse plates of the outer body portion 141. The edges of the plates 142 and 143 are curved out of the plane of the plates so as to present a smooth surface, the ends of the edges touching the surfaces of the plates 142 and 143.

The annular plates 144, 145 and 146, 147 of the outer body portion are curved outwardly away from the interleaved part of the inner body portion but do not touch the surfaces of the plates.

FIG. 8 illustrates schematically part of another IOT in accordance with the invention and is a longitudinal section showing some components only of the IOT. The components are cylindrically symmetrical about the axis X—X and only half is shown.

The input cavity 149 of the IOT includes an outer body portion defined by plates 150 and 151 in combination with an outer cylindrical wall (not shown). A metal cylinder 152 is mounted on one of the plates 150 via a plurality of screws 153, one of which is shown, around its circumference. Two annular plates 154 and 155 are fixed at each end of the cylinder 152 and extend radially inwardly from it. The IOT includes a grid electrode 156 which is mounted on an annular plate 157 which surrounds it and is extensive between the plates 154 and 155 forming part of the outer body portion of the input cavity 149. The plates 154, 155 and 157 together define an r.f. choke impedance which prevents loss of r.f. energy from the cavity 149. The plates 154 and 155 have inner edges which are curved outwardly away from the plate 157 located between them. The interleaved plate 157 is located in a plane which is spaced a distance a from the lower plate 155 in an axial direction and a larger distance b from the upper plate 155. However, the curvature of its end is such that the nearest point of the interleaved plate 154 from the upper plate 155 is also a in the axial direction. The region between plates 154, 155 and 157 includes electrically insulating material 158 to improve voltage hold-off between the plates and hence permit relatively large potential differences to be applied between the inner body portion and the outer body portion.

The plate 151 defining the outer body portion is also electrically connected to two annular plates 159 and 160 and a generally cylindrical outer member 161 to which they are mounted. A central plate 162 of the inner body portion is connected to the cathode (not shown) of the IOT electron gun. The spacing of the inner body portion 162 relative to the plates 159 and 160 is arranged in a similar manner to that of plates 154, 155 and 157.

In this arrangement, the inner body portion of the input cavity 149 is essentially defined by the plates 157 and 162 which themselves are also the parts of the inner body portion which are co-extensive with corresponding parts of the outer body portion.

FIG. 9 illustrates an arrangement similar to that shown in FIG. 8. However, in this arrangement, the plates 163 and 164 forming part of the inner body portion are spaced equidistantly between adjacent plates 165 and 166; 167 and 168 respectively, of the outer body portion. The radial inner edges of the outer body portion plates and the outer edge of the inner body plates are defined by beading of substantially circular cross-section to give the required curved edge in accordance with the invention.

We claim:

1. In a linear electron beam tube having at least means for providing voltages thereto, an electron gun, and an output resonant cavity operatively arranged together, an arrangement comprising:

an internal body portion;

an external body portion; and an insulating portion;

wherein said internal body portion, external body portion, and insulating portion at least partially define an annular input resonant cavity, said internal body portion is provided with a high voltage, with respect to said external body portion, from said means for providing voltages, and said internal and external body portions are separated by said insulating portion so that said internal and external body portions have no electrically conductive connection therebetween;

wherein said internal body portion is in electrical contact with the electron gun;

wherein said annular input resonant cavity at least partially defined by said internal and external body portions surrounds the electron gun;

wherein said annular input resonant cavity includes two transverse walls, at least one of the transverse walls being part of the internal body portion and part of the external body portion, and said insulating portion comprising a member of insulating material disposed between these body portion parts;

wherein both of said transverse walls are part of the internal body portion and the external body portion; and wherein the member of insulating material is extensive between both of said transverse walls.

2. In a linear electron beam tube having at least means for providing voltages thereto, an electron gun, and an output resonant cavity operatively arranged together, an arrangement comprising:

an internal body portion;

an external body portion; and an insulating portion;

wherein said internal body portion, external body portion, and insulating portion at least partially define an annular input resonant cavity, said internal body portion is provided with a high voltage, with respect to said external body portion, from said means for providing voltages, and said internal and external body portions are separated by said insulating portion so that said internal and external body portions have no electrically conductive connection therebetween;

wherein said internal body portion is in electrical contact with the electron gun;

wherein said annular input resonant cavity at least partially defined by said internal and external body portions surrounds the electron gun;

wherein said annular input resonant cavity includes two transverse walls, at least one of the transverse walls being part of the internal body portion and part of the external body portion, and said insulating portion comprising a member of insulating material disposed between these body portion parts;

wherein said annular input resonant cavity comprises a primary resonant cavity;

wherein the arrangement further comprises a secondary resonant cavity coupled to said primary resonant cavity;

wherein the secondary resonant cavity has an associated resonant frequency and means for tuning the resonant frequency of said secondary resonant cavity; and wherein the means for tuning the resonant frequency of said secondary resonant cavity comprises a plunger and a bore associated with the secondary resonant cavity, the plunger being arranged to project from the bore into said secondary resonant cavity so as to vary the volume thereof.

3. An arrangement as claimed in claim 2 wherein said plunger is adjusted by means of an adjusting screw coupled to the plunger and extending through said bore.

4. In a linear electron beam tube having at least means for providing voltages thereto, an electron gun, and an output resonant cavity operatively arranged together, an arrangement comprising:

an internal body portion;

an external body portion; and an insulating portion;

wherein said internal body portion, external body portion, and insulating portion at least partially define an annular input resonant cavity, said internal body portion is provided with a high voltage, with respect to said external body portion, from said means for providing voltages, and said internal and external body portions are separated by said insulating portion so that said internal and external body portions have no electrically conductive connection therebetween;

wherein said internal body portion is in electrical contact with the electron gun;

wherein said annular input resonant cavity at least partially defined by said internal and external body portions surrounds the electron gun;

wherein said annular input resonant cavity includes two transverse walls, at least one of the transverse walls being part of the internal body portion and part of the external body portion, and said insulating portion comprising a member of insulating material disposed between these body portion parts;

wherein said internal and external body portions are physically held in a fixed relationship by said insulating portion; and wherein an external electrical connection is provided to said internal body portion through said insulating portion.

5. An arrangement as claimed in claim 4, wherein said external body portion is provided with a relatively low voltage from said means for providing voltages.

6. In a linear electron beam tube having at least means for providing voltages thereto, an electron gun, and an output resonant cavity operatively arranged together, an arrangement comprising:

an internal body portion;

an external body portion; and an insulating portion;

wherein said internal body portion, external body portion, and insulating portion at least partially define an annular input resonant cavity, said internal body portion is provided with a high voltage, with respect to said external body portion, from said means for providing voltages, and said internal and external body portions are separated by said insulating portion so that said internal and external body portions have no electrically conductive connection therebetween;

wherein said internal body portion is in electrical contact with the electron gun;

wherein said annular input resonant cavity at least partially defined by said internal and external body portions surrounds the electron gun;

wherein said annular input resonant cavity includes two transverse walls, at least one of the transverse walls being part of the internal body portion and part of the external body portion, and said insulating portion comprising a member of insulating material disposed between these body portion parts;

wherein said external body portion is provided with a relatively low voltage from said means for providing voltages; and wherein said external body portion is at a ground potential voltage.

7. An arrangement as claimed in claim 6, wherein said annular input resonant cavity has a radial extent, and said input resonant cavity includes inner and outer input cavity portions, the outer input cavity portion having a greater radial extent than the inner input cavity portion.

8. An arrangement as claimed in claim 7 wherein said outer input cavity portion extends further in an axial direction normal to the radial extent of the annular input cavity than said inner input cavity portion.

9. An arrangement as claimed in claim 6, wherein said electron gun is centrally located and wherein said input resonant cavity arrangement defines an input resonant cavity of substantially annular cross section, the cavity encircling the electron gun.

10. An arrangement as claimed in claim 6, wherein said internal and external body portions are physically held in a fixed relationship by said insulating portion.

11. An arrangement as claimed in claim 6, wherein the electron beam tube is an inductive output tetrode device.

12. An arrangement as claimed in claim 6, wherein said resonant cavity defines a volume therein and said external body portion includes means for varying the volume of said input resonant cavity.

13. An arrangement as claimed in claim 6, wherein said annular input resonant cavity comprises:

a primary resonant cavity; and wherein the arrangement further comprises a secondary resonant cavity coupled to said primary resonant cavity.

14. An arrangement as claimed in claim 13 wherein said primary resonant cavity and said secondary resonant cavity are tuned to different respective frequencies.

15. An arrangement as claimed in claim 13 wherein said primary and secondary resonant cavities are coupled to each other by means of a respective loop provided in each of said primary and secondary resonant cavity, said loops being electrically connected together.

16. An arrangement as claimed in claim 15 wherein said loops are movable and the degree of coupling is controllable by movement of one or both loops.

17. An arrangement as claimed in claim 13 wherein the primary resonant cavity has an associated resonant frequency and means for tuning the resonant frequency of said primary resonant cavity.

18. An arrangement as claimed in claim 13 wherein the secondary resonant cavity has an associated resonant frequency and means for tuning the resonant frequency of said secondary resonant cavity.

19. An arrangement as claimed in claim 13 wherein the primary and secondary resonant cavities have associated resonant frequencies and respective means for tuning the resonant frequencies of said primary and secondary resonant cavities independently.

20. In a linear electron beam tube having at least means for providing voltages thereto, an electron gun, and an output resonant cavity operatively arranged together, an arrangement comprising:

an internal body portion;

an external body portion; and an insulating portion;

wherein said internal body portion, external body portion, and insulating portion at least partially define an annular input resonant cavity, said internal body portion is provided with a high voltage, with respect to said external body portion, from said means for providing voltages, and said internal and external body portions are separated by said insulating portion so that said internal and external body portions have no electrically conductive connection therebetween;

wherein said internal body portion is in electrical contact with the electron gun;

wherein said annular input resonant cavity at least partially defined by said internal and external body portions surrounds the electron gun;

wherein said annular input resonant cavity includes two transverse walls, at least one of the transverse walls being part of the internal body portion and part of the external body portion, and said insulating portion comprising a member of insulating material disposed between these body portion parts;

wherein said annular input resonant cavity comprises a primary resonant cavity;

wherein the arrangement further comprises a secondary resonant cavity coupled to said primary resonant cavity;

wherein said input resonant cavity is for coupling external r.f. energy into the tube from an external source; and wherein said internal and external body portions comprise members which extend into said isolation portion and are mutually interleaved at an interleaved area therein, said members having dimensions which provide a very low r.f. impedance path at the interleaved area thereby inhibiting r.f. leakage from said input resonant cavity.

21. In a linear electron beam tube having at least means for providing voltages thereto, an electron gun, and an output resonant cavity operatively arranged together, an arrangement comprising:

an internal body portion;

an external body portion; and an insulating portion;

wherein said internal body portion, external body portion, and insulating portion at least partially define an annular input resonant cavity, said internal body portion is provided with a high voltage, with respect to said external body portion, from said means for providing voltages, and said internal and external body portions are separated by said insulating portion so that said internal and external body portions have no electrically conductive connection therebetween;

wherein said internal body portion is in electrical contact with the electron gun;

wherein said annular input resonant cavity at least partially defined by said internal and external body portions surrounds the electron gun;

wherein said annular input resonant cavity includes two transverse walls, at least one of the transverse walls being part of the internal body portion and part of the external body portion, and said insulating portion comprising a member of insulating material disposed between these body portion parts;

wherein said annular input resonant cavity is for coupling external r.f. energy from an external source into the tube;

wherein said annular input cavity has a radial direction; and wherein said internal and external body portions comprise members which extend into said insulating portion and are mutually interleaved at a interleaved area therein, said members having dimensions which provide a very low r.f. impendance path at the interleaved area thereby inhibiting r.f. leakage from said input resonant cavity.

22. An arrangement as claimed in claim 21 wherein the mutually interleaved members comprise:

a first annular disc extensive from said internal body portion into said insulating portion; and second and third annular discs extensive from said external body portion into said insulating portion, said second and third annular discs overlapping the first annular disc in the radial direction in the insulating portion, wherein regions of said insulating portion separate said second and first, and said first and third discs, respectively, and thereby insulate the internal body portion provided with said high voltage from the external body portion.

23. An arrangement as claimed in claim 22 wherein said input resonant cavity includes an inner input cavity portion and an outer input cavity portion, the outer input cavity portion having a greater radial extent than the inner input cavity portion, the radial extent of said outer input cavity portion being defined by the external body portion.

24. An electron beam tube amplifier arrangement comprising:

an input section including a centrally disposed electron gun incorporating a cathode and a grid, the input section being surrounded by an annular primary input cavity, the annular primary input cavity being coupled to a secondary input cavity, the secondary input cavity having a coupling for receiving radio frequency signals from an external source; and an output section, operatively coupled to and interacting with said input section to provide for amplifying of the radio frequency signals, said output section incorporating at least one drift tube, the output section being surrounded by a primary output cavity, the primary output cavity being coupled to a secondary output cavity, the secondary output cavity having a coupling for outputting amplified radio frequency signals to an external device;

wherein said annular primary input cavity comprises:

an internal body portion comprising upper and lower annular metal plates, the upper plate being electrically connected with the cathode of the electron gun, and the lower plate being electrically connected with the grid of the electron gun;

an external body portion comprising upper and lower annular metal surfaces, and upper and lower flanges fixed to the upper and lower annular metal surfaces, respectively; and an insulating portion comprised of a dielectric material, the insulating portion separating the upper and lower annular plates of the internal body portion, and separating the internal body portion from the external body portion and the flanges thereof;

wherein the internal body portion and the external body portion, including the flanges thereof, are interleaved in the insulating portion, whereby the internal body portion, the insulating portion, and the external body portion realizes the annular primary input cavity, overlapping channels disposed between the internal and external body portions in the insulating portion providing a relatively high impedance path for radio frequency signals to thereby minimize radio frequency leakage through the insulating portion.

25. A linear electron beam tube having a longitudinal axis, the tube comprising:

an input cavity which is substantially cylindrical about the longitudinal axis and arranged to receive, in use, a high frequency signal to be amplified;

an electron gun arranged to produce an electron beam in a direction substantially parallel to the longitudinal axis; and an output cavity, interacting with said input cavity for amplifying the high frequency signal and having an output from which an amplified high frequency signal is to be extracted;

wherein the input cavity substantially surrounds the electron gun and comprises an inner body portion electrically connected to a part of the electron gun and an outer body portion electrically insulated from the inner body portion, the inner body portion being maintained at a relatively high voltage compared to a voltage potential applied to the outer body portion;

wherein the inner and outer body portions each include an axially extensive flange substantially co-extensive in a direction of the longitudinal axis and electrically insulating material being located between the flanges;

wherein said input resonant cavity includes two transverse walls, at least one of the transverse walls being part of the inner body portion and part of the outer body portion, and insulating means comprising a member of insulating material disposed between these body portion parts; and wherein the inner body portion comprises two sections which are electrically separate from one another.

26. A tube as claimed in claim 25, wherein each one of the flanges is substantially cylindrical in shape.

27. A tube as claimed in claim 25, wherein each of the inner and outer body portions includes two flanges extensive in a direction of the longitudinal axis away from the input cavity.

28. A tube as claimed in claim 27 wherein the insulating material is in the form of a single member which is extensive between both pairs of flanges.

29. A tube as claimed in claim 25, wherein the inner body portion is electrically connected to a cathode and a grid of the electron gun.

30. A linear electron beam tube having a longitudinal axis, the tube comprising:

an input cavity which is substantially cylindrical about the longitudinal axis and arranged to receive, in use, a high frequency signal to be amplified;

an electron gun arranged to produce an electron beam in a direction substantially parallel to the longitudinal axis; and an output cavity, interacting with said input cavity for amplifying the high frequency signal and having an output from which an amplified high frequency signal is to be extracted;

wherein the input cavity substantially surrounds the electron gun and comprises an inner body portion electrically connected to a part of the electron gun and an outer body portion electrically insulated from the inner body portion, the inner body portion being maintained at a relatively high voltage compared to a voltage potential applied to the outer body portion, and wherein the inner and outer body portions have respective parts which are co-extensive to present a choke impedance to high frequency energy within the input cavity, and wherein an edge of one or more of the parts, which terminates in a region where a part of the other body portion is extensive, is curved.

31. A tube as claimed in claim 30 wherein the inner and outer body portions include two pairs of co-extensive respective parts.

32. A tube as claimed in claim 30 wherein the respective parts of the inner and outer body portions which are co-extensive are substantially planar and the curved edge of one or more of the parts is curved away from substantially planar.

33. A tube as claimed in claim 32 wherein the curved edge is curved to an extent such that an end thereof is substantially adjacent a region of a part remote from the edge.

34. A tube as claimed in claim 30 wherein said respective parts are extensive in planes substantially transverse to the longitudinal axis.

35. A tube as claimed in claim 34 wherein one of the body portions includes two parts extensive in a substantially transverse direction to the longitudinal axis and the other of the body portions includes one part extensive in the direction substantially transverse to the longitudinal axis and interleaved between the two parts of the other portion.

36. A tube as claimed in claim 35 wherein said two parts have edges which curve in a direction away from said one part.

37. A tube as claimed in claim 36 wherein said one part is located nearer one of said two parts than the other of said two parts and has an edge which is curved away from the closer part.

38. A tube as claimed in claim 34 wherein the parts are annular plates.

39. A tube as claimed in claim 30 wherein said parts are axially extensive flanges which are substantially co-extensive in a direction of the longitudinal axis.

40. A tube as claimed in claim 39 wherein each one of the flanges is substantially cylindrical in shape.

41. A tube as claimed in claim 30 and including electrically insulating material located between said co-extensive parts.

42. A tube as claimed in claim 41 wherein the electrically insulating material is comprised of resiliently deformable silicone rubber.

43. A linear electron beam tube having a longitudinal axis, the tube comprising:

an input cavity which is substantially cylindrical about the longitudinal axis and arranged to receive, in use, a high frequency signal to be amplified;

an electron gun arranged to produce an electron beam in a direction substantially parallel to the longitudinal axis; and an output cavity, interacting with said input cavity for amplifying the high frequency signal and having an output from which an amplified high frequency signal is to be extracted; wherein the input cavity substantially surrounds the electron gun and comprises an inner body portion electrically connected to a part of the electron gun and an outer body portion electrically insulated from the inner body portion, the inner body portion being maintained at a relatively high voltage compared to a voltage potential applied to the outer body portion, and wherein the inner and outer body portions have respective parts which are substantially co-extensive and resiliently deformable electrically insulating material is located between said parts.

44. A tube as claimed in claim 43 wherein the inner and outer body portions include two pairs of co-extensive respective parts.

45. A tube as claimed in claim 44 wherein the insulating material comprises a single member which is extensive between both pairs of parts.

46. A tube as claimed in claim 43 wherein said respective parts are members which are extensive in planes substantially transverse to the longitudinal axis.

47. A tube as claimed in claim 46 wherein one of the inner body portions includes two members extensive in a substantially transverse direction to the longitudinal axis and the other of the body portions includes one member extensive in the direction substantially transverse to the longitudinal axis and interleaved between the two members of the other portion.

48. A tube as claimed in claim 44 wherein said parts are axially extensive flanges which are substantially co-extensive in a direction of the longitudinal axis.

49. A tube as claimed in claim 48 wherein each one of the flanges is substantially cylindrical in shape.

50. A tube as claimed in claim 48 wherein each of the inner and outer body portions includes two flanges extensive in a direction of the longitudinal axis away from the input cavity.

51. A tube as claimed in claim 43 wherein the resiliently deformable electrically insulating material is silicone rubber.

* * * * *